US005187772A

United States Patent [19]

Rumbley

[11] Patent Number: 5,187,772

[45] Date of Patent: Feb. 16, 1993

[54] ELECTRIC WATER HEATER WITH RADIALLY EXTENDING OVERLAPPED HORIZONTAL HEATING ELEMENT ARRANGED IN VERTICALLY SPACED ALIGNED SETS

[75] Inventor: Ronald J. Rumbley, Hartsville, S.C.

[73] Assignee: AOS Holding Company, Wilmington, Del.

[21] Appl. No.: 718,689

[22] Filed: Jun. 21, 1991

[51] Int. Cl.[5] ..... H05B 3/82; F24H 1/20

[52] U.S. Cl. ..... 392/449; 122/305; 165/110; 219/523; 392/401; 392/451; 392/454; 392/500

[58] Field of Search ..... 165/110; 126/351; 122/305-310; 219/523; 392/449, 451, 401, 500, 454

[56] References Cited

U.S. PATENT DOCUMENTS 1,818,861 8/1931 Otis ..... 392/401
2,035,962 3/1936 Hock ..... 165/110
2,531,385 11/1950 Barneby ..... 392/501 X

FOREIGN PATENT DOCUMENTS 278024 9/1927 United Kingdom ..... 392/453

*Primary Examiner*—Anthony Bartis
*Attorney, Agent, or Firm*—David R. Price; James Earl Lowe, Jr.

[57] ABSTRACT

An electric water heater includes a cylindrical tank with an inner surface defining a water chamber having a central vertical axis. Three sets of three electric immersion heating extend radially inwardly into the water chamber from the inner surface. The heating elements of such set define generally horizontal planes vertically spaced apart along the vertical axis. The heating elements of each set lie in angularly spaced generally vertical planes intersecting the central axis and being spaced approximately 120° apart with the inner ends of the respective heating elements being in overlapping spaced relationship along the vertical axis to provide the most heat at the center of the chamber where it is most needed.

16 Claims, 1 Drawing Sheet

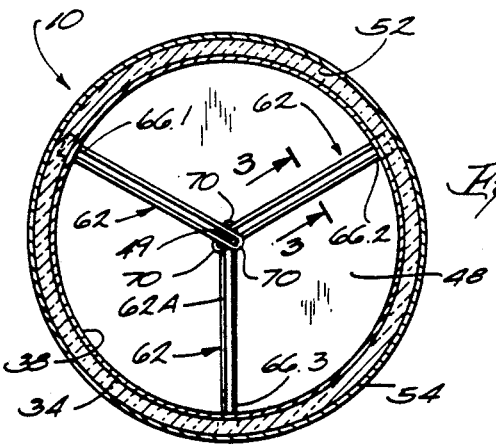
Fig. 2.
Fig. 4
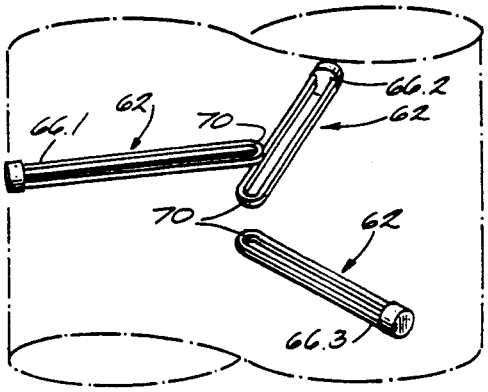
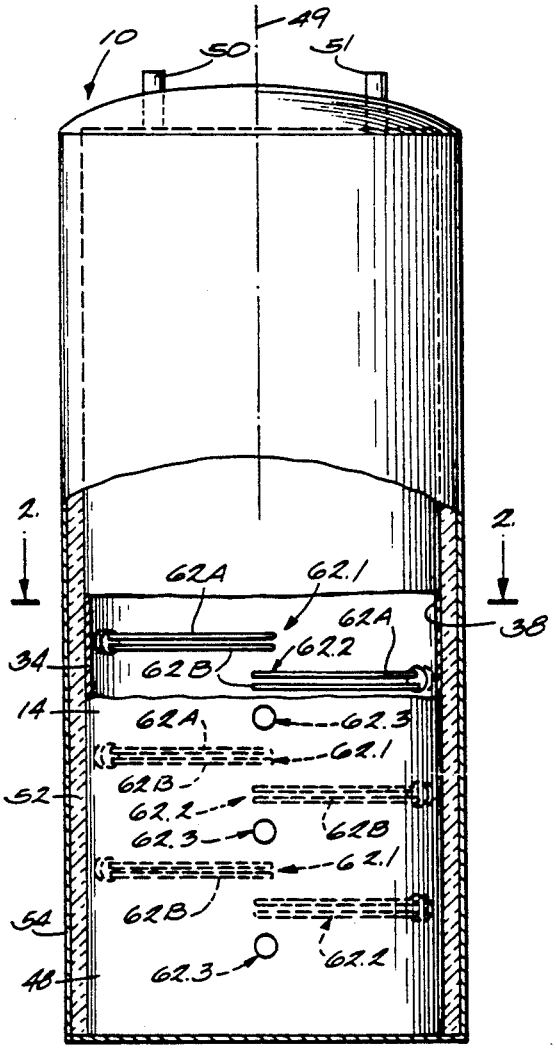
Fig. 1
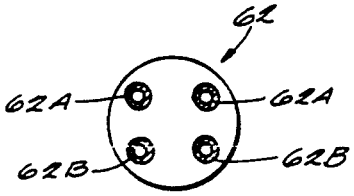
Fig. 3

ELECTRIC WATER HEATER WITH RADIALLY EXTENDING OVERLAPPED HORIZONTAL HEATING ELEMENT ARRANGED IN VERTICALLY SPACED ALIGNED SETS

BACKGROUND OF THE INVENTION

The invention relates to electric water heaters, and more particularly to water heaters with electric heating elements extending radially inwardly from the tank wall and into the water chamber.

A known water heater includes a plurality of heating elements spaced axially along the water chamber, i.e., spaced vertically in a typical water heater. The heating elements are located one above the other or in a single plane having therein the longitudinal axis of the water chamber.

Another water heater construction is shown in U.S. Pat. No. 3,569,668, which discloses a horizontally oriented water chamber with angularly spaced heating elements located only in the lower half of the water chamber. The angular spacing of the heating elements is within the range of 30°-60°.

SUMMARY OF THE INVENTION

The invention provides an electric water heater with a more efficient arrangement of heating elements than in known prior art water heaters. This arrangement heats the water more evenly and provides the most heat where it is most needed.

More particularly, the invention provides a water heater comprising a cylindrical tank including an inner surface defining a cylindrical water chamber centered on a vertical axis. The water heater also comprises a plurality (preferably three) of sets of heating elements extending radially inwardly from the inner surface of the tank.

Each set of heating elements includes three elements spaced apart approximately 120°. Each element has an outer end connected to the tank wall and an inner end located approximately on the water chamber axis, so that the inner ends of the heating elements overlap in the center of the water chamber. Each heating element extends horizontally, and the heating elements are vertically spaced, so that the inner ends of the heating elements are spaced one above the other.

The even spacing of the heating elements provides more even heating of the water within the water chamber. The overlapping of the heating elements in the center of the water chamber provides the most heat in the center of the water chamber, where it is most needed.

Other features and advantages of the invention will become apparent to those skilled in the art upon review of the following detailed description, claims and drawings.

DESCRIPTION OF THE DRAWINGS

FIG. 1 is an elevational view, partially in section, of a water heater embodying the invention and including three sets of heating elements.

FIG. 2 is a view taken along line 2—2 in FIG. 1.

FIG. 3 is a view taken along line 3—3 in FIG. 2.

FIG. 4 is a perspective view of a set of heating elements.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT OF THE INVENTION

Shown in FIG. 1 is an electric water heater 10 embodying various of the features of the invention. The water heater 10 of the illustrated embodiment is in the shape of an upright cylinder.

The water heater 10 includes a tank 14 in the shape of a hollow, closed right cylinder oriented in an upright manner. The water tank 14 includes a cylindrical wall 34 having an inner cylindrical surface 38 defining a cylindrical water chamber 48. The water chamber 48 is centered on a longitudinal or vertical cylinder axis 49. Cold water enters the water chamber 48 via an inlet 50, and heated water exits the tank 14 via an outlet 51.

The tank 14 is surrounded by insulation 52 which, in turn, is surrounded by an outer skin or jacket 54. The insulation 52 and jacket 54 are made of any appropriate material conventionally used for those purposes. The tank 14 is vertically supported in a conventional manner.

The water heater 10 further includes a plurality of heating elements 62 extending into the water chamber 48 from the inner surface 38 of the tank wall 34. Each heating element 62 has (see FIG. 2) an outer end 66 connected to the inner surface 38, has an inner end 70 spaced from the inner surface 38, and extends radially inwardly from the inner surface 38 along a horizontal line perpendicular to the axis 49. Each heating element 62 includes (see FIGS. 1 and 3) a first or upper, generally U-shaped element portion 62A defining a horizontal plane perpendicular to the longitudinal axis 49. Each heating element 62 further includes a second or lower, generally U-shaped element portion 62B generally parallel to the portion 62A. The element portion 62B defines a second plane that is perpendicular to the longitudinal axis 49 and that is parallel to and spaced from the plane defined by the portion 62A. The element portions 62A and 62B extend into the water chamber 48, from the inner surface 38, a distance that is slightly greater than the radial distance between the inner surface 38 and the longitudinal axis 49. This results in overlapping of the inner ends 70 of the heating elements. The heating element portions 62A and 62B are electrically energized, in a conventional fashion, when it is desired to heat the water contained in the water chamber 48.

In the illustrated embodiment, the water heater 10 comprises three sets of heating elements 62, with the heating elements 62 of each set being generally equi-angularly spaced (see FIG. 2) relative to the axis 49 and being vertically spaced (see FIG. 1) from one another. In the preferred embodiment, each set comprises three heating elements 62, each heating element 62 of a set being angularly spaced by 120° from each of the other heating elements 62 of the set. In other words, the angles defined by each element 62 and the adjacent element 62 in either direction are equal. It has been determined that this equi-angularly spaced arrangement tends to heat water in the tank 14 more evenly. Further, it has been determined that the overlapping of the inner ends 70 of the heating elements of each set provides the most heat in the center of the water chamber 48, where it is most needed.

In the illustrated embodiment, as shown in FIG. 2, each heating element 62 of each set is vertically aligned with one element 62 of each of the other sets so as to define a vertical plane including the axis 49. Thus, the elements 62 define three vertical planes that intersect along the axis 49 and that are spaced approximately 120° apart, and each of the heating elements 62 is located in one of the three planes.

Various of the features of the invention are set forth in the following claims.

I claim:

1. A water heater comprising a tank including an inner surface defining a water chamber having a central vertical axis, and a plurality of heating elements extending into said water chamber and defining generally horizontal planes spaced apart along said central vertical axis, each of said heating elements having an outer end connected to said inner surface and an inner end spaced from said inner surface, said heating elements extending in angularly spaced planes intersecting along said axis, and the inner end of one of said heating elements being in overlapping relationship along the central vertical axis of said chamber to the inner end of another of said heating elements.

2. A water heater as set forth in claim 1 wherein each of said heating elements extends along a line generally perpendicular to said axis.

3. A water heater as set forth in claim 1 wherein the inner ends of said heating elements are spaced along said axis.

4. A water heater as set forth in claim 1 wherein the angles defined by each of said heating elements and the adjacent heating element in either direction are substantially equal.

5. A water heater as set forth in claim 1 wherein said water heater comprises three heating elements each spaced approximately 120° from the other two heating elements.

6. A water heater as set forth in claim 5 wherein said water heater comprises a plurality of sets of three heating elements spaced approximately 120° apart.

7. A water heater as set forth in claim 6 wherein each of said heating elements is located in one of three planes intersecting along said axis and being spaced approximately 120° apart.

8. A water heater as set forth in claim 1 wherein each of said heating elements is located in one of three planes intersecting along said axis and being spaced approximately 120° apart.

9. A water heater comprising a tank including an inner surface defining a water chamber having a central vertical axis, and a plurality of angularly spaced heating elements extending radially inwardly into said water chamber from said inner surface and defining generally horizontal planes spaced apart along said central vertical axis, the angles defined by each of said heating elements and the adjacent heating element in either direction being substantially equal.

10. A water heater as set forth in claim 9 wherein said water heater comprises three heating elements spaced approximately 120° apart.

11. A water heater as set forth in claim 10 wherein said water heater comprises a plurality of sets of three heating elements spaced approximately 120° apart.

12. A water heater as set forth in claim 9 wherein each of said heating elements is located in one of three planes intersection along said axis and being spaced approximately 120° apart.

13. A water heater comprising a tank including an inner surface defining a water chamber having a central vertical axis, and three heating elements extending radially inwardly into said water chamber from said inner surface and defining generally horizontal planes spaced apart along said central vertical axis, each of said heating elements being spaced approximately 120° from the other two heating elements.

14. A water heater as set forth in claim 13 wherein said water heater comprises a plurality of sets of three heating elements spaced approximately 120° apart.

15. A water heater as set forth in claim 14 wherein each of said heating elements is located in one of three planes intersecting along said axis and being spaced approximately 120° apart.

16. A water heater as set forth in claim 13 wherein said water heater further comprises additional heating elements defining generally horizontal planes spaced apart along said central vertical axis and apart from said three heating elements, and wherein each of said three heating elements and said additional heating elements is located in one of three planes intersecting along said axis and being spaced approximately 120° apart.

* * * * *